US012674216B2

(12) United States Patent
Kanetada et al.

(10) Patent No.: US 12,674,216 B2
(45) Date of Patent: Jul. 7, 2026

(54) HIGH-STRENGTH COLD-ROLLED STEEL SHEET, HOT-DIPPED GALVANIZED STEEL SHEET, ALLOYED HOT-DIPPED GALVANIZED STEEL SHEET, AND METHODS FOR PRODUCING OF THESE

(71) Applicant: Kobe Steel, Ltd., Kobe (JP)

(72) Inventors: Shinjiro Kanetada, Kakogawa (JP); Michiharu Nakaya, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 483 days.

(21) Appl. No.: 18/246,001

(22) PCT Filed: Sep. 22, 2021

(86) PCT No.: PCT/JP2021/034887
§ 371 (c)(1),
(2) Date: Mar. 20, 2023

(87) PCT Pub. No.: WO2022/075072
PCT Pub. Date: Apr. 14, 2022

(65) Prior Publication Data

US 2023/0357874 A1 Nov. 9, 2023

(30) Foreign Application Priority Data

Oct. 6, 2020 (JP) ..... 2020-169102

(51) Int. Cl.
*C21D 8/02* (2026.01)
*C21D 8/0221* (2026.01)
(Continued)

(52) U.S. Cl.
CPC ..... *C21D 8/0236* (2013.01); *C21D 8/02* (2013.01); *C21D 8/0226* (2013.01); *C21D 9/46* (2013.01);
(Continued)

(58) Field of Classification Search
None
See application file for complete search history.

(56) References Cited

U.S. PATENT DOCUMENTS

2011/0186189 A1 8/2011 Futamura
2012/0312433 A1 12/2012 Mizuta et al.
(Continued)

FOREIGN PATENT DOCUMENTS

GB 2477419 A 8/2011
IN 201647036465 A 11/2016

OTHER PUBLICATIONS

International Search Report issued Dec. 14, 2021 in PCT/JP2021/034887, filed on Sep. 22, 2021, 2 pages.

*Primary Examiner* — Anthony M Liang
(74) *Attorney, Agent, or Firm* — Oblon, McClelland, Maier & Neustadt, L.L.P.

(57) ABSTRACT

A high-strength cold-rolled steel sheet according to one aspect of the present invention contains, in % by mass: C: 0.070 to 0.140%; Si: 0.80 to 1.80%; and Mn: 1.80 to 2.80%, with the balance being iron and unavoidable impurities; in area ratio in a structure observed with a scanning electron microscope, bainite, tempered martensite, and hard phases composed of at least one of cementite and MA made up of quenched martensite and retained austenite combined together account for 85% or more in total, the hard phase that has a breadth of 0.4 μm or less and a length of 1.2 μm or more accounts for 0.5% or more, the hard phase that has a breadth of 1.2 μm or more accounts for 5.0% or less, and structures other than the bainite, the tempered martensite, and the hard phase account for 15% or less; and in volume ratio measured by X-ray diffractometry, retained austenite accounts for 3.0% or more and 7.0% or less.

5 Claims, 2 Drawing Sheets

(51) Int. Cl.

| | |
|---|---|
| ***C21D 9/46*** | (2006.01) |
| ***C22C 38/02*** | (2006.01) |
| ***C22C 38/04*** | (2006.01) |
| ***C23C 2/28*** | (2006.01) |
| ***C23C 2/40*** | (2006.01) |

(52) U.S. Cl.

CPC ..... *C22C 38/02* (2013.01); *C22C 38/04* (2013.01); *C23C 2/28* (2013.01); *C23C 2/29* (2022.08); *C23C 2/40* (2013.01); *C21D 2211/001* (2013.01); *C21D 2211/002* (2013.01); *C21D 2211/003* (2013.01); *C21D 2211/008* (2013.01)

(56) References Cited

U.S. PATENT DOCUMENTS

| | | | |
|---|---|---|---|
| 2018/0010207 | A1 | 1/2018 | Futamura et al. |
| 2018/0037964 | A1 | 2/2018 | Murata et al. |
| 2018/0044752 | A1 | 2/2018 | Murata et al. |
| 2018/0171442 | A1 | 6/2018 | Tsunezawa et al. |

HIGH-STRENGTH COLD-ROLLED STEEL SHEET, HOT-DIPPED GALVANIZED STEEL SHEET, ALLOYED HOT-DIPPED GALVANIZED STEEL SHEET, AND METHODS FOR PRODUCING OF THESE

CROSS REFERENCE TO RELATED APPLICATIONS

This application is a National Stage entry under 35 U.S.C. § 371 of PCT/JP2021/034887, filed on Sep. 22, 2021, and claims priority to Japanese Patent Application No. 2020-169102, filed on Oct. 6, 2020, the entire contents of which are incorporated herein by reference.

TECHNICAL FIELD

The present invention relates to a high-strength cold-rolled steel sheet, a hot-dip galvanized steel sheet and a hot-dip galvannealed steel sheet using the same, and methods for producing these steel sheets.

BACKGROUND ART

In recent years, with the increase in strength of members for automobiles, members for transport machines, and the like, steel sheets to be used for these members have also been increased in strength. In such a high-strength steel sheet, formability such as ductility and stretch-flangeability is deteriorated as the strength is increased. Therefore, it is difficult to press mold a member having a complicated shape using a high-strength steel sheet such as a steel sheet for automobiles or a steel sheet for transport machines.

In addition, the high-strength steel sheet has reduced local ductility such as bendability and stretch-flangeability. Therefore, there is a problem that when the high-strength steel sheet is applied to a member intended to absorb impact energy at the time of collision among the vehicle body structural members, the member is cracked during collision deformation.

In order to cope with these problems, there is a demand for development of a high-strength steel sheet superior in formability and cracking resistance during collision deformation (hereinafter referred to as "collision characteristics").

When a steel sheet for automobiles is applied to a vehicle body structural member for the purpose of absorbing impact energy, the steel sheet is required to be hardly cracked when receiving a large load due to collision and being deformed at a high speed. Such a member is subjected to severe bending deformation due to buckling at the time of deformation. Therefore, as a steel sheet to be used for such a member, a high-strength steel sheet superior in local ductility such as bendability and stretch-flangeability is considered to be suitable.

Examples of literatures disclosing a technique related to the above characteristics of a steel sheet include Patent Literatures 1 and 2.

Patent Literature 1 discloses, as a plated steel sheet having superior formability including elongation, bendability, and hole expandability (stretch-flangeability), a high-strength plated steel sheet in which a low-temperature transformation phase is contained in an amount of 70 area % or more relative to the entire metal structure, and pearlite, quenched martensite, and an MA mixed phase, which is a composite phase of quenched martensite and retained austenite, are contained in an amount of 15 area % or less relative to the entire metal structure when a metal structure is observed with a scanning electron microscope.

Patent Literature 2 discloses, as a high-strength cold-rolled steel sheet superior in both of formability evaluated as ductility and stretch-flangeability and collision characteristics, a high-strength cold-rolled steel sheet in which the circle-equivalent diameter of an MA structure in which quenched martensite and retained austenite are combined is 2.0 μm or less, and the ratio $V_{MA}/V_{\gamma}$ of the area ratio $V_{MA}$ of the MA structure to the volume ratio $V_{\gamma}$ of the retained austenite satisfies $0.50 \leq V_{MA}/V_{\gamma} \leq 1.50$.

However, as a result of investigation by the inventors of the present application, it is considered that the steel sheets disclosed in Patent Literatures 1 and 2 have room for further improvement in stretch-flangeability and bendability.

The present invention has been devised in view of the above circumstances, and an object thereof is to provide a high-strength cold-rolled steel sheet superior in stretch-flangeability and bendability, and a hot-dip galvanized steel sheet and a hot-dip galvannealed steel sheet each having a hot-dip galvanized layer or a hot-dip galvannealed layer on a surface of the high-strength cold-rolled steel sheet. Another object of the present invention is to provide methods for producing the high-strength cold-rolled steel sheet, the hot-dip galvanized steel sheet, and the hot-dip galvannealed steel sheet.

CITATION LIST

Patent Literature

Patent Literature 1: Japanese Patent No. 6085348
Patent Literature 2: Japanese Patent No. 6554396

SUMMARY OF INVENTION

As a result of various studies, the present inventors have found that the above objects are achieved by the following inventions.

A high-strength cold-rolled steel sheet according to one aspect of the present invention contains, in % by mass: C: 0.070 to 0.140%; Si: 0.80 to 1.80%; and Mn: 1.80 to 2.80%, with a balance being iron and unavoidable impurities; in area ratio in a structure observed with a scanning electron microscope, bainite, tempered martensite, and hard phases composed of at least one of cementite and MA made up of quenched martensite and retained austenite combined together account for 85% or more in total, the hard phase that has a breadth of 0.4 μm or less and a length of 1.2 μm or more accounts for 0.5% or more, the hard phase that has a breadth of 1.2 μm or more accounts for 5.0% or less, and structures other than the bainite, the tempered martensite, and the hard phases account for 15% or less; and in volume ratio measured by X-ray diffractometry, retained austenite accounts for 3.0% or more and 7.0% or less.

A hot-dip galvanized steel sheet and a hot-dip galvannealed steel sheet according to another aspect of the present invention include the above-described high-strength cold-rolled steel sheet and a hot-dip galvanized layer or a hot-dip galvannealed layer each provided on a surface of the high-strength cold-rolled steel sheet.

A method for producing a high-strength cold-rolled steel sheet according to another aspect of the present invention includes, in this order, a rolling step of subjecting a steel slab satisfying the above-described composition sequentially to hot rolling and cold rolling; a heating step of heating the steel sheet obtained by cold rolling the steel slab to a temperature region of ($Ac_3$ point+200° C.) or lower while adjusting a heating rate at 700° C. or more to 1.5° C./sec or more and 30° C./sec or less; a soaking step of holding the steel sheet subjected to the heating step for 10 seconds or more and 100 seconds or less; a first cooling step of cooling the steel sheet subjected to the soaking step to a first cooling temperature of 100° C. or higher and 410° C. or lower at a cooling rate of 10° C./sec or more and 50° C./sec or less; a holding step of holding the steel sheet cooled to the first cooling temperature at a holding temperature of 100° C. or higher and 410° C. or lower for 10 seconds or more and 80 seconds or less; and a second cooling step of cooling the steel sheet subjected to the holding step to room temperature at a cooling rate of 15° C./sec or more.

In a method for producing a hot-dip galvanized steel sheet and a method for producing a hot-dip galvannealed steel sheet according to another aspect of the present invention, the steel sheet is further subjected to galvanization or sequentially to galvanization and alloying treatment before the second cooling step in the above-described method for producing the high-strength cold-rolled steel sheet.

BRIEF DESCRIPTION OF DRAWINGS

FIGS. 2(A) to 2(D) are schematic diagrams of a heat pattern of an annealing step, in which FIG. 2(A) is a basic pattern, FIG. 2(B) is a pattern having a reheating step, FIG. 2(C) is a pattern having a plating (alloying) step, and FIG. 2(D) is a pattern having a reheating step and a plating (alloying) step.

DESCRIPTION OF EMBODIMENTS

Figure 1:
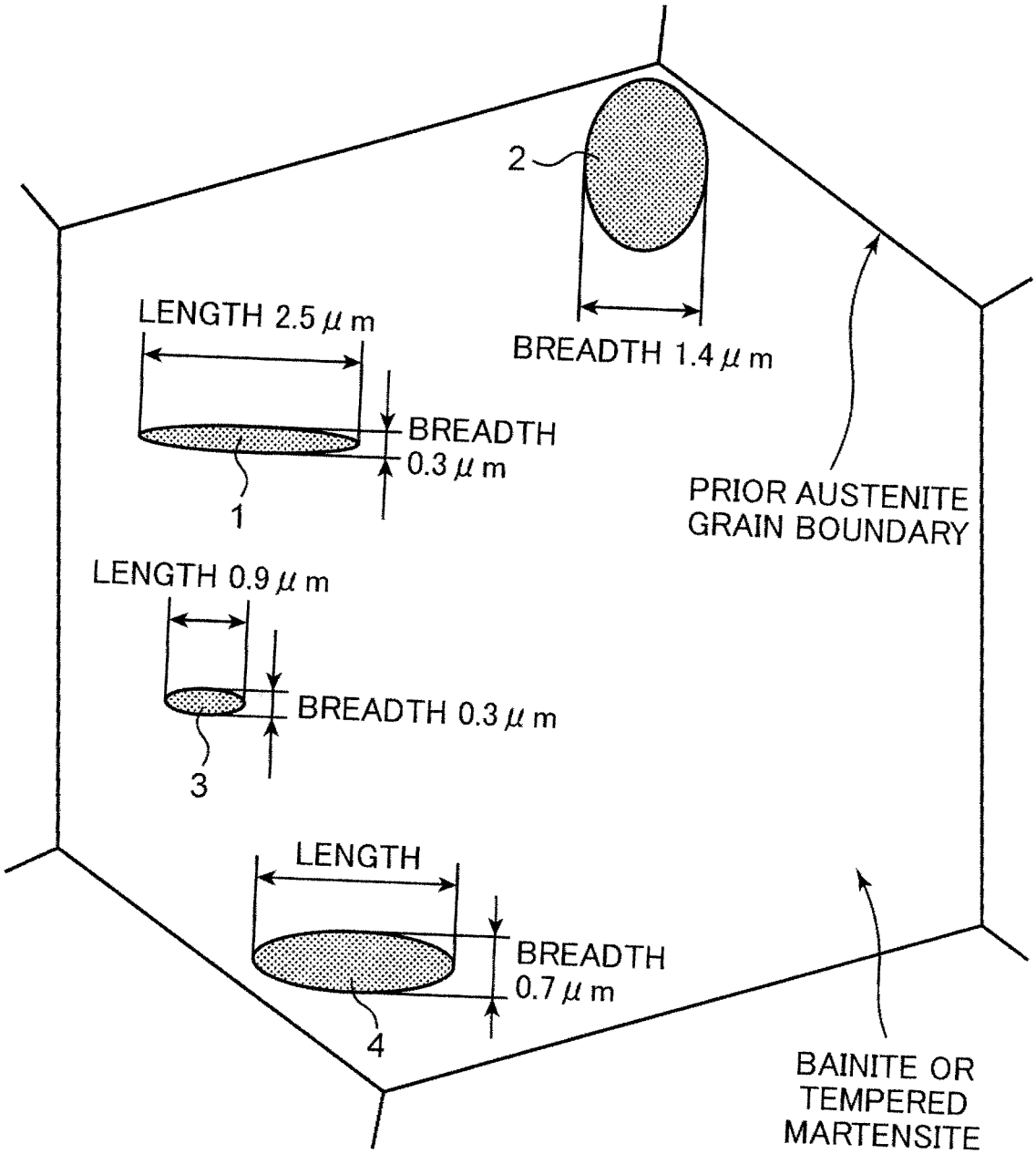
FIG. 1 is a schematic diagram for explaining the sizes and shapes of the hard phases prescribed in the present embodiment.

In order to provide a high-strength cold-rolled steel sheet having a tensile strength of 900 MPa or more and being superior in stretch-flangeability and bendability, the present inventors have conducted intensive studies while focusing on the chemical composition, the constituent structure, the volume ratio of retained austenite, the size and shape of MA and cementite of steel sheets. Specifically, considering that the constituent structure of a steel sheet and the size and shape of MA and cementite dispersed in the structure affect stretch-flangeability and bendability, they investigated these structures in detail.

As a result, they have found that good stretch-flangeability and bendability are admirably achieved in a high-strength cold-rolled steel sheet if the chemical composition of the steel sheet, the constituent structure, the volume ratio of retained austenite, and the area ratios of MA and cementite with prescribed sizes and shapes in the structure respectively satisfy the prescribed requirements described later, so that the present invention has been accomplished.

According to the present invention, it is possible to provide a high-strength cold-rolled steel sheet superior in stretch-flangeability and bendability, a hot-dip galvanized steel sheet having a hot-dip galvanized layer on a surface of the high-strength cold-rolled steel sheet, and a hot-dip galvannealed steel sheet having a hot-dip galvannealed layer on a surface of the high-strength cold-rolled steel sheet.

According to the present invention, it is also possible to provide methods for producing such a high-strength cold-rolled steel sheet, a hot-dip galvanized steel sheet, and a hot-dip galvannealed steel sheet.

In the following description, "high strength" referred to for a steel sheet, a hot-dip galvanized steel sheet, and a hot-dip galvannealed steel sheet means "a tensile strength of 900 MPa or more". In addition, "MA" prescribed in the present invention is an abbreviation of "Martensite-Austenite Constituent", and is a structure in which quenched martensite and retained austenite are combined.

Hereinafter, a high-strength cold-rolled steel sheet according to one embodiment of the present invention and a method for producing the same will be described.

(Metal Structure of High-Strength Cold-Rolled Steel Sheet)

In the high-strength cold-rolled steel sheet according to the present embodiment, in area ratio in a structure observed with a scanning electron microscope, bainite, tempered martensite, and hard phases composed of at least one of cementite and MA made up of quenched martensite and retained austenite combined together for 85% or more in total, the hard phase that has a breadth of 0.4 μm or less and a length (a major diameter) of 1.2 μm or more accounts for 0.5% or more, the hard phase that has a breadth (a minor diameter) of 1.2 μm or more accounts for 5.0% or less, and structures other than the bainite, the tempered martensite, and the hard phases account for 15% or less; and in volume ratio measured by X-ray diffractometry, retained austenite accounts for 3.0% or more and 7.0% or less. Accordingly, a high-strength cold-rolled steel sheet superior in stretch-flangeability and bendability can be obtained.

(Hard Phase)

The hard phases prescribed in the present embodiment are composed of at least one of MA and cementite. MA is a composite of quenched martensite and retained austenite. In the high-strength cold-rolled steel sheet according to the present embodiment, in an area ratio accounted for in a structure observed with a scanning electron microscope (SEM), a hard phase that has a breadth of 0.4 μm or less and a length of 1.2 μm or more (hereinafter also referred to as "first hard phase") accounts for 0.5% or more, a hard phase that has a breadth of 1.2 μm or more (hereinafter also referred to as "second hard phase") accounts for 5.0% or less.

FIG. 1 is a schematic diagram for explaining the sizes and shapes of the hard phases prescribed in the present embodiment. Hereinafter, reference numerals in the diagram denote 1: hard phase (first hard phase) and 2: hard phase (second hard phase). In the present embodiment, an observation photograph of a cross section of the steel sheet taken using a SEM is subjected to image processing by a computer, and the breadth, the length, and the area of each hard phases in the cross section are measured.

As shown in FIG. 1, in the structure of the high-strength cold-rolled steel sheet according to the present embodiment, hard phases exist together with bainite or tempered martensite. The hard phase 1 shown in FIG. 1 has a length of 2.5 μm and a breadth of 0.3 μm, and corresponds to the first hard phase. The hard phase 2 has a breadth of 1.4 μm and corresponds to the second hard phase. The hard phase 3 shown in FIG. 1 has a length of 0.9 μm and a breadth of 0.3 μm, and corresponds to neither the first hard phase nor the second hard phase. The hard phase 4 has a breadth of 0.7 μm and corresponds to neither the first hard phase nor the second hard phase.

When the area ratio of the first hard phase is less than 0.5%, the stretch-flangeability and the bendability of the steel sheet deteriorate. Although the reason is not necessarily clear, it can be considered as follows. That is, it is assumed that in the case where the area ratio of the first hard phase is less than 0.5%, when the steel sheet is subjected to stretch-flange deformation or bending deformation, microcracks/cracks are likely to propagate in the steel sheet structure, so that the stretch-flangeability/the bendability of the steel sheet deteriorate. The area ratio of the first hard phase is preferably 0.55% or more, and more preferably 0.60% or more.

The reason why the area ratio is defined for the first hard phase, that is, the hard phase having "a breadth of 0.4 μm or less and a length of 1.2 μm or more" is as follows. It is considered that when a hard phase has a breadth of 0.4 μm or less, the hard phase can deform in the same manner as the surrounding structure when the steel sheet is deformed. In addition, it is considered that when the length is 1.2 μm or more, the function as an obstacle for propagation of microcracks/cracks in the structure is sufficiently significant. Therefore, it is considered that the stretch-flangeability and the bendability of a steel sheet can be evaluated by the area ratio of a hard phase having "a breadth of 0.4 μm or less and a length of 1.2 μm or more".

When the amount of the second hard phase is more than 5.0% in area ratio, the stretch-flangeability and the bendability of the steel sheet deteriorate. Although the reason is not necessarily clear, it can be considered as follows. That is, it is assumed that in the case where the area ratio of the second hard phase is more than 5.0%, when the steel sheet is subjected to stretch-flange deformation or bending deformation, microcracks are likely to generate in the steel sheet structure, so that the stretch-flangeability/the bendability of the steel sheet deteriorate. The area ratio of the second hard phase is preferably 4.8% or less, and more preferably 4.6% or less.

The reason why the area ratio is defined for the second hard phase, that is, the hard phase having "a breadth of 1.2 μm or more" is as follows. It is considered that when a hard phase has a breadth of 1.2 μm or more, the hard phase cannot deform in the same manner as the surrounding structure and can serve as a source of microcracks when the material is deformed. Therefore, it is considered that the stretch-flangeability and the bendability of a steel sheet can be evaluated by the area ratio of a hard phase having "a breadth of 1.2 μm or more"

(Retained Austenite)

The influence of retained austenite in a microstructure on the properties of a high-strength cold-rolled steel sheet is clear. Therefore, in the high-strength cold-rolled steel sheet according to the present embodiment, in a volume ratio measured by X-ray diffractometry, the volume ratio of retained austenite relative to the entire structure is prescribed to be 3.0% or more and 7.0% or less. The volume ratio of retained austenite is preferably 3.5% or more, and more preferably 4.0% or more. The volume ratio of retained austenite is preferably 6.5% or less, and more preferably 6.0% or less.

When the volume ratio of retained austenite is less than 3.0%, the ductility improvement effect due to transformation-induced plasticity of retained austenite during processing of the steel sheet is poor, so that the ductility of the steel sheet deteriorates. On the other hand, when the volume ratio of retained austenite exceeds 7.0%, the retained austenite becomes martensite through the strain-induced transformation due to stress and becomes a source of microcracks/cracks, so that the stretch-flangeability and the bendability of the steel sheet deteriorate.

Retained austenite is contained in bainite in the structure observed by SEM, and cannot be independently observed. For this reason, in the high-strength cold-rolled steel sheet according to the present embodiment, the area ratio of retained austenite in the structure observed by SEM is not defined.

(Bainite, Tempered Martensite)

In the high-strength cold-rolled steel sheet according to the present embodiment, the bainite structure and the tempered martensite constitute a matrix structure of the high-strength cold-rolled steel sheet. In order to satisfy the area ratio of the hard phases and the volume ratio of retained austenite described above, bainite and tempered martensite are set to account for 85% or more in total, in area ratio in the structure observed by SEM. The total of the area ratios of bainite and tempered martensite is preferably 90% or more, and more preferably 95% or more. The high-strength steel sheet according to the present embodiment may contain only one of the bainite structure and the tempered martensite without containing both the bainite structure and the tempered martensite.

(Other Structures)

In the high-strength cold-rolled steel sheet according to the present embodiment, the area ratio of the structures other than the bainite, the tempered martensite, and the hard phases (hereinafter also referred to as "balance structure") is set to 15% or less in total in the structure observed with SEM. Examples of main structures constituting the balance structure include as-quenched martensite (in the present embodiment, the as-quenched martensite includes self-tempered martensite), and ferrite and pearlite, which are unavoidably formed.

The reason why the area ratio of the balance structure is specified to be 15% or less in total is that when a large number of structures having different hardness, such as hard as-quenched martensite, soft ferrite, and pearlite having an intermediate hardness between those of the as-quenched martensite and the ferrite, are mixed in the structure of the steel sheet, the stretch-flangeability and the bendability are deteriorated due to the difference in hardness among the structures. The area ratio of the balance structure is preferably 10% or less, and more preferably 5% or less in total.

(Chemical Composition)

In the high-strength cold-rolled steel sheet according to the present embodiment, the chemical composition is not particularly limited as long as the above-described constituent structure, the area ratios of the hard phases having the prescribed sizes and shapes, and the volume ratio of retained austenite can be obtained. However, since C, Si, and Mn have a large influence on the strength of a steel sheet and the amount of retained austenite, they are prescribed in the following composition ranges. Hereinafter, the reason for specifying the composition range of each element will be described. "%" in the following description of the chemical composition means "% by mass".

(C: 0.070 to 0.140%)

C is an element necessary for securing the strength of the steel sheet. The amount of C is set to 0.070% or more because the tensile strength of the steel sheet decreases if the amount of C is insufficient. The lower limit of the amount of C is preferably 0.080% or more, and more preferably 0.090% or more. However, if the amount of C is excessive, the area ratio of coarse MA and the volume ratio of retained austenite increase, and the stretch-flangeability and the bendability of the steel sheet decrease. Therefore, the upper limit of the amount of C is set to 0.140% or less. The upper limit of the amount of C is preferably 0.130% or less, and more preferably 0.120% or less. More preferably, the upper limit of the amount of C is 0.110% or less.

(Si: 0.80 to 1.80%)

Si is known as a solid-solution strengthening element and is an element that effectively acts to improve the tensile strength while controlling the decrease in the ductility of the steel sheet. In addition, Si is an element that is also effective in securing the volume ratio of retained austenite. In order to allow such an effect to be effectively exhibited, the amount of Si needs to be set to 0.80% or more. The lower limit of the amount of Si is preferably 1.10% or more, and more preferably 1.40% or more.

However, if the amount of Si is excessive, the volume ratio of retained austenite also increases, and the stretch-flangeability and the bendability of the steel sheet decrease. Therefore, the upper limit of the amount of Si is set to 1.80% or less. The upper limit of the amount of Si is preferably 1.70% or less, and more preferably 1.60% or less.

(Mn: 1.80 to 2.80%)

Mn is an element that contributes to strengthening of the steel sheet. In order to allow such an effect to be effectively exhibited, the amount of Mn needs to be set to 1.80% or more. The lower limit of the amount of Mn is preferably 1.9% or more, and more preferably 2.0% or more. However, if the amount of Mn is excessive, the ductility and the stretch-flangeability of the steel sheet deteriorate. Therefore, the upper limit of the amount of Mn is set to 2.80% or less. The upper limit of the amount of Mn is preferably 2.70% or less, and more preferably 2.60% or less.

The basic components of the high-strength cold-rolled steel sheet according to the present embodiment are as described above, and the balance is substantially iron. However, it is naturally allowable that impurities unavoidably brought in depending on the circumstances of raw materials, facility materials, production equipment, and the like are contained in steel. Examples of such unavoidable impurities include P and S, which are described below.

(P: More than 0% and 0.015% or Less)

P is an element that is unavoidably contained, segregates at grain boundaries, and promotes grain boundary embrittlement, and P deteriorates the bendability of the steel sheet, so that it is recommended to reduce the amount of P as much as possible. For this reason, the amount of P is preferably 0.015% or less, more preferably 0.013% or less, and still more preferably 0.010% or less. P is an impurity unavoidably mixed in steel, and it is impossible to reduce the amount of P to 0% in industrial production.

(S: More than 0% and 0.0050% or Less)

Similarly to P, S is also an element contained unavoidably. Since S generates inclusions and degrades the stretch-flangeability of the steel sheet, it is recommended that the amount of S be reduced as much as possible. For this reason, the amount of S is preferably 0.0050% or less, more preferably 0.0040% or less, and still more preferably 0.0030% or less. S is an impurity unavoidably mixed in steel, and it is impossible to reduce the amount of S to 0% in industrial production.

The unavoidable impurities contained in the steel include, for example, N and O in addition to P and S. The amounts of N and O are preferably in the following ranges, respectively.

(N: More than 0% and 0.0100% or Less)

N is unavoidably present as an impurity element, and deteriorates the bendability of the steel sheet. Thus, the amount of N is preferably 0.0100% or less, more preferably 0.0060% or less, and still more preferably 0.0050% or less. The smaller the amount of N, the more preferable. However, it is difficult to reduce the amount of N to 0% in industrial production.

(O: More than 0% and 0.0020% or Less)

O is unavoidably present as an impurity element, and deteriorates the bendability of the steel sheet. Thus, the amount of O is preferably 0.0020% or less, more preferably 0.0015% or less, and still more preferably 0.0010% or less. The smaller the amount of O, the more preferable. However, it is difficult to reduce the amount of O to 0% in terms of industrial production.

The high-strength cold-rolled steel sheet according to the present embodiment may, as necessary, contain one or more elements selected from the group consisting of Al, Cr, Ti, B, Cu, Ni, Cr, Mo, V, Nb, and Ca within the following ranges. By incorporating these elements alone or in appropriate combination, the characteristics of the steel sheet are further improved depending on the kind of the elements contained.

(Al: 0.015 to 0.60%)

Al is an element that acts as a deoxidizer. In order to allow such an effect to be effectively exhibited, the amount of Al is preferably 0.015% or more, more preferably 0.025% or more, and still more preferably 0.030% or more. Al is an element effective in securing the volume ratio of retained austenite. However, if the amount of Al is excessive, the $Ac_3$ point may be excessively increased, and the manufacturing cost increases. For this reason, the upper limit of the amount of Al is preferably 0.60% or less, more preferably 0.55% or less, and still more preferably 0.50% or less.

(Cr: More than 0% and 0.60% or Less)

Cr is an element that contributes to strengthening of the steel sheet, and may be contained, as necessary. The effect thereof increases as the content thereof increases. In order to allow such an effect to be effectively exhibited, the amount of Cr is preferably 0.05% or more, more preferably 0.10% or more, and still more preferably 0.15% or more. However, if the amount of Cr is excessive, bare spots may be generated in a hot-dip galvanized steel sheet or a hot-dip galvannealed steel sheet. For this reason, the upper limit of the amount of Cr is preferably 0.60% or less, more preferably 0.55% or less, still more preferably 0.50% or less, and further preferably 0.45% or less.

(Ti: 0.010 to 0.040%)

Ti is an element that forms a carbide or a nitride to improve the strength of the steel sheet. Ti is an element that is effective also in allowing the below-described hardenability improving effect produced by B to be effectively exerted. That is, Ti reduces N in steel by forming a nitride. As a result, the formation of a nitride of B in the steel is controlled, and B in the steel forms a solid solution state, so that the hardenability improving effect by B can be effectively exerted. As described above, Ti improves the hardenability to contributes to strengthening of the steel sheet. In order to allow such an effect to be effectively exhibited, the amount of Ti is preferably 0.010% or more, more preferably 0.013% or more, and still more preferably 0.015% or more.

However, if the amount of Ti is excessive, Ti carbide or Ti nitride is excessive, so that the stretch-flangeability of the steel sheet deteriorates. For this reason, the upper limit of the amount of Ti is preferably 0.040% or less, more preferably 0.035% or less, and still more preferably 0.030% or less.

(B: 0.0015 to 0.0040%)

B is an element that improves the hardenability to contributes to strengthening of the steel sheet. In order to allow such an effect to be effectively exhibited, the amount of B is preferably 0.0015% or more, more preferably 0.0020% or more, and still more preferably 0.0025% or more. However, if the amount of B is excessive, the effect thereof is saturated, so that only the cost increases. For this reason, the amount of B is preferably 0.0040% or less, and more preferably 0.0035% or less.

(Cu: More than 0% and 0.30% or Less)

Cu is an element that is effective for improving the corrosion resistance of the steel sheet, and may be contained, as necessary. The effect thereof increases as the content thereof increases. In order to allow such an effect to be effectively exhibited, the amount of Cu is preferably 0.03% or more, and more preferably 0.05% or more. However, if the amount of Cu is excessive, the effect thereof is saturated, so that the cost increases. For this reason, the upper limit of the amount of Cu is preferably 0.30% or less, more preferably 0.20% or less, and still more preferably 0.15% or less.

(Ni: More than 0% and 0.30% or Less)

Ni is an element that is effective for improving the corrosion resistance of the steel sheet, and may be contained, as necessary. The effect thereof increases as the content thereof increases. In order to allow such an effect to be effectively exhibited, the amount of Ni is preferably 0.03% or more, and more preferably 0.05% or more. However, if the amount of Ni is excessive, the effect thereof is saturated and the cost increases. For this reason, the upper limit of the amount of Ni is preferably 0.30% or less, more preferably 0.20% or less, and still more preferably 0.15% or less.

(Mo: More than 0% and 0.30% or Less)

Mo is an element that contributes to strengthening of the steel sheet, and may be contained, as necessary. The effect thereof increases as the content thereof increases. In order to allow such an effect to be effectively exhibited, the amount of Mo is preferably 0.03% or more, and more preferably 0.05% or more. However, if the amount of Mo is excessive, the effect thereof is saturated and the cost increases. For this reason, the upper limit of the amount of Mo is preferably 0.30% or less, more preferably 0.25% or less, and still more preferably 0.20% or less.

(V: More than 0% and 0.30% or Less)

V is an element that contributes to strengthening of the steel sheet, and may be contained, as necessary. The effect thereof increases as the content thereof increases. In order to allow such an effect to be effectively exhibited, the amount of V is preferably 0.005% or more, and more preferably 0.010% or more. However, if the amount of Vis excessive, the effect thereof is saturated and the cost increases. For this reason, the upper limit of the amount of V is preferably 0.30% or less, more preferably 0.25% or less, still more preferably 0.20% or less, and further preferably 0.15% or less.

(Nb: More than 0% and 0.040% or Less)

Nb is an element that contributes to strengthening of the steel sheet, and may be contained, as necessary. The effect thereof increases as the content thereof increases. In order to allow such an effect to be effectively exhibited, the amount of Nb is preferably 0.003% or more, and more preferably 0.005% or more. However, if the amount of Nb is excessive, the bendability is deteriorated. For this reason, the upper limit of the amount of Nb is preferably 0.040% or less, more preferably 0.035% or less, and still more preferably 0.030% or less.

(Ca: More than 0% and 0.0050% or Less)

Ca is an element that is effective for spheroidizing sulfides in steel and enhancing the bendability, and may be contained, as necessary. The effect thereof increases as the content thereof increases. In order to allow such an effect to be effectively exhibited, the amount of Ca is preferably 0.0005% or more, and more preferably 0.0010% or more. However, if the amount of Ca is excessive, the effect thereof is saturated and the cost increases. For this reason, the upper limit of the amount of Ca is preferably 0.0050% or less, more preferably 0.0030% or less, and still more preferably 0.0025% or less.

(Characteristics of High-Strength Cold-Rolled Steel Sheet)

The high-strength cold-rolled steel sheet according to the present embodiment satisfying the chemical composition, the constituent structure, the volume ratio of retained austenite, and the area ratios of the hard phases having the prescribed sizes and shapes described above has a tensile strength of 900 MPa or more, and is superior in both ductility and stretch-flangeability according to the strength level.

The high-strength cold-rolled steel sheet according to the present embodiment preferably satisfies a tensile strength of 900 MPa or more and satisfies, for example, all of the following characteristics.

The elongation (EL) is preferably 12% or more, and more preferably 13% or more. The stretch-flangeability (hole expansion ratio $\lambda$) is preferably 60% or more, and more preferably 70% or more. The VDA bending angle is preferably 100° or more, and more preferably 105° or more. The upper limit of the elongation EL is not particularly prescribed, but is usually about 18%. The higher the hole expansion ratio $\lambda$, the better the stretch-flangeability, and the upper limit thereof is not particularly limited, but is usually about 100%.

(Hot-Dip Galvanized Steel Sheet and Hot-Dip Galvannealed Steel Sheet)

The hot-dip galvanized steel sheet according to the present embodiment includes the high-strength cold-rolled steel sheet described above and a hot-dip galvanized layer provided on a surface of the high-strength cold-rolled steel sheet. The hot-dip galvannealed steel sheet according to the present embodiment includes the high-strength cold-rolled steel sheet described above and a hot-dip galvannealed layer provided on a surface of the high-strength cold-rolled steel sheet.

Similarly to the high-strength cold-rolled steel sheet according to the present embodiment, the hot-dip galvanized steel sheet and the hot-dip galvannealed steel sheet also have a tensile strength of 900 MPa or more and superior ductility and stretch-flangeability.

Hereinafter, the high-strength cold-rolled steel sheet, the hot-dip galvanized steel sheet, and the hot-dip galvannealed steel sheet according to the present embodiment are also collectively referred to as "high-strength steel sheet".

(Method for Producing High-Strength Cold-Rolled Steel Sheet)

Next, a method for producing the high-strength cold-rolled steel sheet according to the present embodiment will be described.

The method for producing the high-strength cold-rolled steel sheet according to the present embodiment includes: a rolling step of sequentially applying hot rolling and cold rolling to a steel slab; and an annealing step of heating the steel sheet obtained by cold rolling the steel slab to a prescribed temperature region and cooling the steel sheet at a prescribed speed. The high-strength cold-rolled steel sheet according to the present embodiment satisfying the requirements described above can be produced by appropriately controlling especially the annealing step after the cold rolling in this production method.

Hereinafter, the method for producing the high-strength cold-rolled steel sheet according to the present embodiment will be described in the order of the rolling step (hot rolling, cold rolling) and the annealing step. The hot rolling and the cold rolling are not necessarily required to be carried out under the following conditions.

(Rolling Step)

In the rolling step, hot rolling and cold rolling are sequentially applied to a steel slab satisfying the above-described component composition. The conditions for the hot rolling are, for example, as follows.

[Hot Rolling Conditions]

In the hot rolling, a steel slab heated to a prescribed temperature is rolled once or more until the steel slab has a prescribed thickness. If the heating temperature before the hot rolling is low, carbides such as TiC may be difficult to be dissolved in solid in austenite. For this reason, the heating temperature before the hot rolling is preferably 1200° C. or higher, and more preferably 1250° C. or higher. However, if the heating temperature before the hot rolling is excessively high, the cost increases. For this reason, the upper limit of the heating temperature before the hot rolling is preferably 1350° C. or lower, and more preferably 1300° C. or lower.

In the present embodiment, the temperature of the steel slab at the time when the last rolling (finish rolling) in the hot rolling is carried out is referred to as "finish rolling temperature". If the finish rolling temperature of the hot rolling is low, the rolling is not carried out in an austenite single phase region, deformation resistance during rolling increases, so that there is a possibility that operation is difficult. For this reason, the finish rolling temperature is preferably 850° C. or higher, and more preferably 870° C. or higher. However, if the finish rolling temperature is excessively high, crystals may become coarse. For this reason, the finish rolling temperature is preferably 980° C. or lower, and more preferably 950° C. or lower.

The average cooling rate taken from the completion of the finish rolling of the hot rolling to the start of coiling is preferably 10° C./sec or more, and more preferably 20° C./sec or more in consideration of productivity. On the other hand, if the average cooling rate is excessively high, the facility cost increases. For this reason, the average cooling rate is preferably 100° C./sec or less, and more preferably 50° C./sec or less.

Next, the conditions of the process after the hot rolling will be described.

[Coiling Temperature after Hot Rolling]

The steel sheet (hot-rolled steel sheet) obtained by the hot rolling is wound into a coil shape. If the coiling temperature after the hot rolling is lower than 570° C., the strength of the hot-rolled steel sheet increases, and it is difficult to perform rolling by cold rolling. For this reason, the coiling temperature after the hot rolling is preferably 570° C. or higher, more preferably 580° C. or higher, and still more preferably 590° C. or higher. On the other hand, if the coiling temperature after the hot rolling is excessively high, the pickling property for scale removal deteriorates. For this reason, the coiling temperature is preferably 700° C. or lower, more preferably 690° C. or lower, and still more preferably 680° C. or lower.

[Rolling Rate During Cold Rolling]

The hot-rolled steel sheet wound in a coil shape is uncoiled, subjected to pickling for scale removal, and subjected to cold rolling. The rolling ratio during the cold rolling (synonymous with "draft") is preferably 20% or more and 60% or less. In order to obtain a steel sheet having a prescribed thickness with a rolling ratio at the time of cold rolling being less than 20%, it is necessary to reduce the thickness of the hot-rolled steel sheet in the hot rolling step. If the thickness of the hot-rolled steel sheet is reduced, the length of the steel sheet is increased, so that pickling takes time and the productivity deteriorates. For this reason, the rolling ratio during the cold rolling is preferably 20% or more, and more preferably 25% or more. On the other hand, when the rolling ratio during cold rolling exceeds 60%, a high-performance cold-rolling mill is required. For this reason, the upper limit of the rolling ratio during the cold rolling is preferably 60% or less, more preferably 55% or less, and still more preferably 50% or less.

(Annealing Step)

Figure 2:
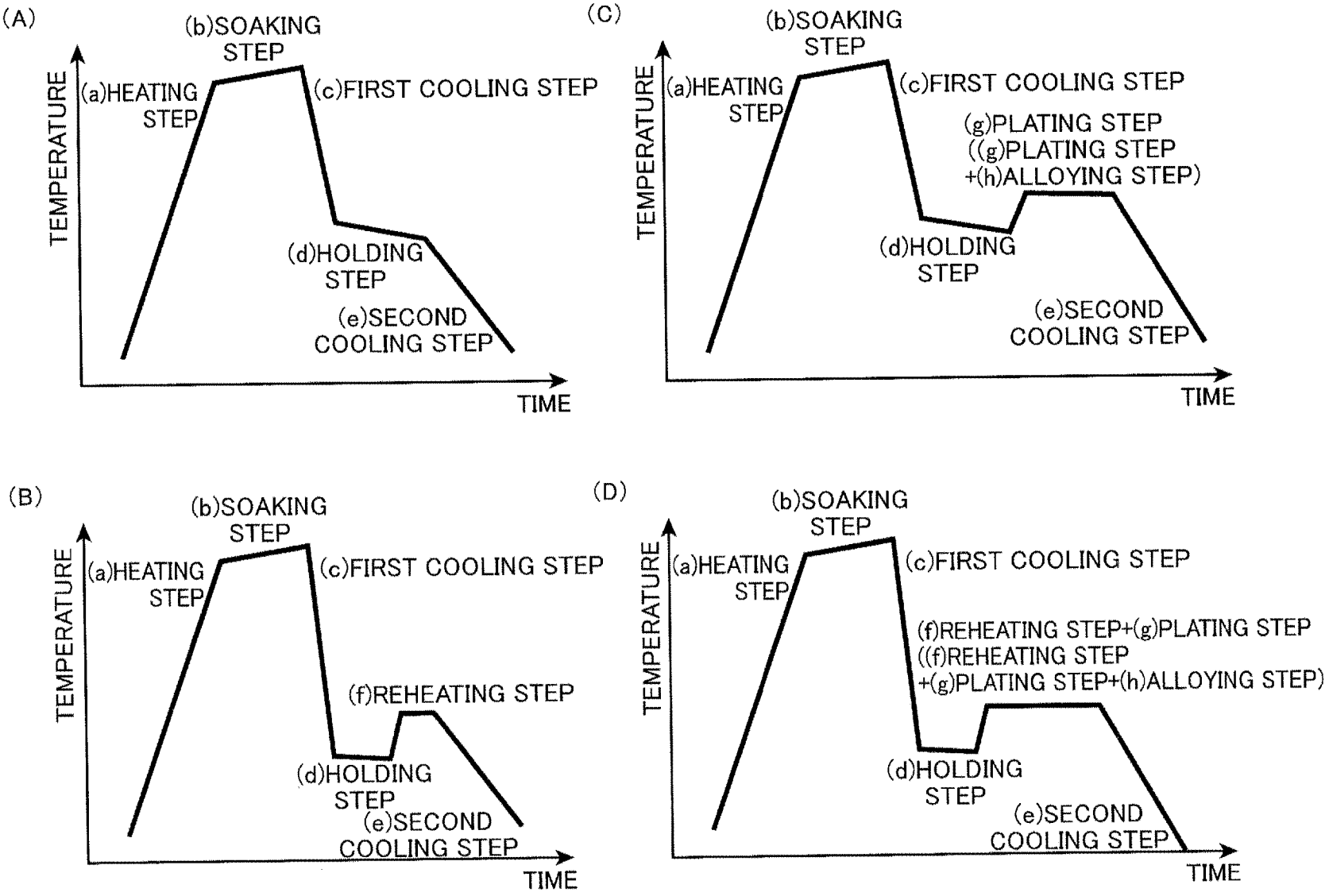

In the annealing step, a steel sheet obtained by hot rolling and cold rolling a steel slab is annealed using an annealing furnace. In order to obtain the high-strength cold-rolled steel sheet according to the present embodiment, it is important to appropriately adjust the conditions in each step included in the annealing step after the cold rolling. In the method for producing the high-strength cold-rolled steel sheet according to the present embodiment, the annealing step includes (a) a heating step, (b) a soaking step carried out subsequent to the heating step, (c) a first cooling step carried out subsequent to the soaking step, (d) a holding step carried out subsequent to the first cooling step, and (e) a second cooling step carried out subsequent to the holding step. A heat pattern (change in temperature of the steel sheet with time) of the annealing step including the steps (a) to (e) is schematically illustrated in FIG. 2(A). Hereinafter, the steps (a) to (e) will be described in order.

(a) Heating Step

In the heating step according to the present embodiment, the cold-rolled steel sheet obtained by cold rolling a steel slab is heated to a temperature region of ($Ac_3$ point+200° C.) or lower, that is, a soaking temperature described later, at a heating rate (that is, the temperature-raising rate) of 1.5° C./sec or more and 30° C./sec or less at 700° C. or higher. The lower limit of the heating temperature region is preferably a lower temperature of the $Ac_3$ point or 950° C. That is, when the $Ac_3$ point is lower than 950° C., heating to a temperature region of the $Ac_3$ point or higher and (the $Ac_3$ point+200° C.) or lower is preferable, and when the $Ac_3$ point is 950° C. or higher, heating to a temperature region of 950° C. or higher and (the $Ac_3$ point+200° C.) or lower is preferable. If the heating rate at 700° C. or higher is less than 1.5° C./sec, the time taken until the temperature reaches the soaking temperature is long and the facility cost increases. For this reason, the lower limit of the heating rate at 700° C. or higher is set to 1.5° C./sec or more.

On the other hand, when the heating rate at 700° C. or higher exceeds 30° C./sec, it is difficult to control the steel sheet temperature, and the facility cost increases. For this reason, the upper limit of the heating rate at 700° C. or higher is set to 30° C./sec or less. The upper limit of the heating rate at 700° C. or higher is preferably 25° C./sec or less, and more preferably 20° C./sec or less. In the heating step according to the present embodiment, the heating rate in the temperature range of lower than 700° C. may be any rate.

(b) Soaking Step

In the soaking step according to the present embodiment, the steel sheet subjected to the heating step is held at a prescribed temperature for a prescribed time. Specifically, in the heating step, the steel sheet is heated to a temperature region of ($Ac_3$ point+200° C.) or lower, and then the steel sheet is held at that temperature for a prescribed time to be soaked. Hereinafter, the temperature for soaking the steel sheet is referred to as "soaking temperature", and the time for soaking the steel sheet is referred to as "soaking time". By setting the soaking temperature to ($Ac_3$ point+200° C.) or lower and holding the soaking temperature for a prescribed soaking time, a steel sheet superior in stretch-flangeability can be produced through the subsequent steps without excessive energy consumption.

If the soaking temperature is lower than the $Ac_3$ point when the $Ac_3$ point is lower than 950° C., or if the soaking temperature is lower than 950° C. when the $Ac_3$ point is 950° C. or higher, ferrite may be generated in the structure in the soaking step, and it may be difficult to secure desired stretch-flangeability. For this reason, the lower limit of the soaking temperature is preferably equal to or higher than the lower one of the $Ac_3$ point or 950° C. By setting the lower limit of the soaking temperature to be equal to or higher than the lower temperature of the $Ac_3$ point or 950° C. and holding the soaking temperature for a prescribed soaking time, the area ratio of austenite in the entire structure can be adjusted to 85% or more. The lower limit of the soaking temperature is more preferably equal to or higher than the lower temperature of (the $Ac_3$ point+10° C.) or 960° C.

On the other hand, if the soaking temperature is a high temperature exceeding the $Ac_3$ point+200° C., energy for industrially producing a high-strength cold-rolled steel sheet is excessively required. For this reason, the upper limit of the soaking temperature is set to the $Ac_3$ point+200° C. or lower. The upper limit of the soaking temperature is preferably the $Ac_3$ point+150° C. or lower.

Here, the $Ac_3$ point of the steel sheet is calculated based on the following formula (1). (% [Element name]) in the equation is the content (% by mass) of each element, and the content of the element not contained in the steel sheet is calculated as 0%. The following equation (1) was cited from "The Physical Metallurgy of Steels" (published by Maruzen Co., Ltd., written by William C. Leslie, p. 273).

$$Ac_3\text{ point}=910-203(\%\ C)^{1/2}-15.2(\%\ Ni)+44.7(\%\ Si)+104(\%\ V)+31.5(\%\ Mo)+13.1(\%\ W)-30(\%\ Mn)-11(\%\ Cr)-20(\%\ Cu)+700(\%\ P)+400(\%\ Al)+120(\%\ As)+400(\%\ Ti) \quad (1)$$

In the soaking step according to the present embodiment, the soaking time is set to 10 seconds or more and 100 seconds or less. By setting the soaking time to 10 seconds or more and 100 seconds or less and holding at the above-described soaking temperature, the area ratio of austenite in the entire structure can be adjusted to 85% or more, and a steel sheet superior in stretch-flangeability can be produced with high productivity through the subsequent steps. If the soaking time is less than 10 seconds, it is difficult to secure desired stretch-flangeability due to generation of excessive ferrite, or the like. For this reason, the lower limit of the soaking time is set to 10 seconds or more. The lower limit of the soaking time is preferably 13 seconds or more. On the other hand, if the soaking time exceeds 100 seconds, productivity decreases. For this reason, the upper limit of the soaking time is 100 seconds or less. The upper limit of the soaking time is preferably 80 seconds or less.

In the soaking step, the soaking temperature is preferably kept constant at the temperature at the end of the heating step, that is, the temperature at which the temperature raise of the steel sheet is stopped. However, the soaking temperature may vary as long as the soaking temperature is in a temperature region of ($Ac_3$ point+200° C.) or lower (preferably, equal to or higher than the lower temperature of the $Ac_3$ point or 950° C.) and the heating rate is less than the heating rate at 700° C. or higher, and the temperature at the start of soaking and the temperature at the end of soaking may be different. The fact that the temperature gradually rises in the soaking step of FIG. 2(A) means that the temperatures of the furnace and the steel sheet continues to slightly rise even if the temperature raise of the annealing furnace is stopped.

(c) First Cooling Step

In the first cooling step according to the present embodiment, the steel sheet subjected to the soaking step is cooled to a prescribed cooling stop temperature (hereinafter referred to as "first cooling temperature") at a prescribed cooling rate. The cooling rate from the soaking temperature to the first cooling temperature (hereinafter referred to as "first cooling rate") is 10° C./sec or more and 50° C./sec or less.

It is considered that if the first cooling rate is less than 10° C./sec, the area ratio of the first hard phase decreases and the area ratio of the second hard phase increases, so that the stretch-flangeability decreases. For this reason, the lower limit of the first cooling rate is set to 10° C./sec or more. The lower limit of the first cooling rate is preferably 15° C./sec or more, and more preferably 18° C./sec or more.

On the other hand, if the first cooling rate exceeds 50° C./sec, it is difficult to control the steel sheet temperature, and the facility cost increases. For this reason, the upper limit of the first cooling rate is set to 50° C./sec or less. The upper limit of the first cooling rate is preferably 40° C./sec or less, and more preferably 30° C./sec or less.

The first cooling temperature is set to 100° C. or higher and 410° C. or lower. By cooling the steel sheet at the above-described first cooling rate to a temperature region of 100° C. or higher and 410° C. or lower, a steel sheet structure based on bainite or a steel sheet structure based on as-quenched martensite can be formed.

If the first cooling temperature is lower than 100° C., the volume ratio of retained austenite decreases and the ductility deteriorates. For this reason, the lower limit of the first cooling temperature is 100° C. or higher. The lower limit of the first cooling temperature is preferably 150° C. or higher, and more preferably 200° C. or higher.

On the other hand, if the first cooling temperature exceeds 410° C., the area ratio of the first hard phase is lower than 0.5%, or the area ratio of the second hard phase is higher than 5.0%, so that the stretch-flangeability and the bendability of the steel sheet deteriorate. For this reason, the upper limit of the first cooling temperature is set to 410° C. or lower. The upper limit of the first cooling temperature is preferably 400° C. or lower.

In the first cooling step, the structure of the steel sheet can be controlled by controlling the first cooling temperature. Specifically, by setting the first cooling temperature to 350° C. or higher and 410° C. or lower, a steel sheet structure based on bainite (85% or more in area ratio) can be obtained. In addition, by setting the first cooling temperature to 100° C. or more and lower than 350° C., it is possible to obtain a steel sheet structure based on as-quenched martensite, and further, by providing a later-described reheating step after the first cooling step, it is possible to obtain a steel sheet structure based on tempered martensite (85% or more in area ratio) by tempering the as-quenched martensite.

(d) Holding Step

In the holding step after the first cooling step, the holding temperature is set to 100° C. or higher and 410° C. or lower, and the holding time is set to 80 seconds or less.

If the holding temperature in the holding step is lower than 100° C., the volume ratio of retained austenite decreases and the ductility deteriorates. For this reason, the lower limit of the holding temperature in the holding step is set to 100° C. or higher. The holding temperature is preferably 150° C. or higher, and more preferably 200° C. or higher.

On the other hand, if the holding temperature in the holding step exceeds 410° C., the area ratio of the first hard phase is lower than 0.5%, or the area ratio of the second hard phase is higher than 5.0%, so that the stretch-flangeability and the bendability of the steel sheet deteriorate. For this reason, the upper limit of the holding temperature in the holding step is set to 410° C. or lower. The upper limit of the holding temperature in the holding step is preferably 400° C. or lower.

In addition, it is considered that if the holding time in the holding step is less than 10 seconds, the enrichment of C due to diffusion from the bainite or martensite generated in the first cooling step into untransformed austenite does not sufficiently proceed and the martensite transformation of the untransformed austenite excessively proceeds in the second cooling step. Therefore, it is considered that the volume ratio of retained austenite decreases and the ductility deteriorates. On the other hand, it is considered that if the holding time in the holding step exceeds 80 seconds, bainite transformation or martensite transformation of untransformed austenite excessively proceeds. Therefore, it is considered that the volume ratio of retained austenite decreases and the ductility deteriorates. In addition, if the holding time exceeds 80 seconds, the productivity decreases. For this reason, the upper limit of the holding time is set to 80 seconds or less.

In the holding step, the holding temperature is preferably kept constant at the temperature at the end of the first cooling step. However, the holding temperature may be different at the start of the holding step and at the end of the holding step. Specifically, the holding temperature may vary as long as the temperature is in a temperature region of 100° C. or higher and 410° C. or lower and at a temperature-lowering rate lower than the first cooling rate. The fact that the temperature gradually lowers in the holding step of FIG. 2(A) means that the temperatures of the furnace and the steel sheet continues to slightly lower even if the temperature reduction of the annealing furnace is stopped.

When the first cooling temperature is set to 350° C. or higher and 410° C. or lower, the holding temperature is also preferably set to 350° C. or higher and 410° C. or lower. As a result, the steel sheet structure based on bainite generated in the first cooling step can be maintained also in the holding step. Similarly, when the first cooling temperature is set to 100° C. or higher and lower than 350° C., the holding temperature is also preferably set to 100° C. or higher and lower than 350° C. As a result, the steel sheet structure based on as-quenched martensite generated in the first cooling step can be maintained also in the holding step.

(e) Second Cooling Step

In the second cooling step, after the holding step, cooling is carried out at a cooling rate of 15° C./sec or more from the holding temperature at the end of the holding step. In the high-strength cold-rolled steel sheet according to the present embodiment, since the amount of C is as small as 0.140% or less, it is difficult to obtain retained austenite. Therefore, it is considered that if the cooling rate in the second cooling step (hereinafter also referred to as "second cooling rate") is less than 15° C./sec, the volume ratio of retained austenite decreases and the ductility deteriorates. For this reason, the lower limit of the second cooling rate is set to 15° C./sec or more. The lower limit of the second cooling rate is preferably 18° C./sec or more. The upper limit of the second cooling rate is not particularly limited, and is, for example, 30° C./sec or less. The cooling stop temperature in the second cooling step is also not particularly limited, and cooling may be normally carried out to room temperature.

In the annealing step of the method for producing the high-strength steel sheet according to the present embodiment, one or both of a reheating step (f) and a plating step (g) may be added in addition to the steps (a) to (e) described above. In addition, an alloying step (h) may be added to the plating step (g). Hereinafter, each of the steps (f) to (h) will be described.

(f) Reheating Step

In the method for producing the high-strength steel sheet according to the present embodiment, as shown in FIG. 2(B), a reheating step (f) of reheating the steel sheet to a temperature of 400° C. or higher and 500° C. or lower and holding the steel sheet for 10 seconds or more may be provided between the holding step (d) and the second cooling step (e).

In the reheating step, the as-quenched martensite produced in the first cooling step and held in the holding step can be tempered and a steel sheet structure based on tempered martensite (85% or more in area ratio) can be obtained. When the reheating step is provided, in order to generate as-quenched martensite in the first cooling step, the first cooling temperature in the first cooling step is set to 100° C. or higher and lower than 350° C., and the holding temperature in the holding step is set to 100° C. or higher and lower than 350° C. After the reheating step, the above-described second cooling step is carried out.

(g) Plating Step, (h) Alloying Step

In the method for producing the high-strength steel sheet according to the present embodiment, provision of a step of applying galvanization to the steel sheet (a plating step) before the second cooling step makes it possible to produce a hot-dip galvanized steel sheet according to the present embodiment. In addition, in the method for producing the high-strength steel sheet according to the present embodiment, provision of a step of sequentially applying galvanization and alloying treatment to the steel sheet (a plating step and an alloying step) before the second cooling step makes it possible to produce a hot-dip galvannealed steel sheet according to the present embodiment. Specifically, as shown in FIG. 2(C), the plating step (g), or the plating step (g) and the alloying step (h) are carried out before the second cooling step (e).

The hot-dip galvanized steel sheet according to the present embodiment can be produced by subjecting the steel sheet subjected to the holding step (d) to galvanization by a common method (immersion in a galvanization bath at about 460° C. for about 1 to 5 seconds) (the plating step (g)), and then subjecting the steel sheet to cooling in the second cooling step (e) described above.

The hot-dip galvannealed steel sheet according to the present embodiment can be produced by subjecting the steel sheet subjected to the holding step (d) to galvanization by a common method (immersion in a galvanization bath at about 460° C. for about 1 to 5 seconds) (the plating step (g)), further subjecting the steel sheet to alloying treatment of hot-dip galvanization and steel (heating to 430 to 550° C. and holding for 20 to 40 seconds) (the alloying step (h)), and then subjecting the steel sheet to cooling in the second cooling step (e).

When the plating step (g) is provided, the first cooling temperature in the first cooling step (c) is set to 350° C. or higher and 410° C. or lower, and the holding temperature in the holding step (d) is set to 350° C. or higher and 410° C. or lower, whereby a hot-dip galvanized steel sheet or a hot-dip galvannealed steel sheet having a steel sheet structure based on bainite can be obtained.

In the method for producing the hot-dip galvanized steel sheet and the method for producing the hot-dip galvannealed steel sheet according to the present embodiment, the reheating step (f) may be provided before the plating step (g). Specifically, as shown in FIG. 2(D), the reheating step (f) is carried out after the holding step (d) and before the second cooling step (e), and the plating step (g) is carried out following the reheating step (f). After the plating step (g), the alloying step (h) may be carried out.

When the reheating step (f) and the plating step (g) are provided, the first cooling temperature in the first cooling step is set to 100° C. or higher and lower than 350° C., and the holding temperature in the holding step is set to 100° C. or higher and lower than 350° C., whereby a hot-dip galvanized steel sheet or a hot-dip galvannealed steel sheet having a steel sheet structure based on tempered martensite can be obtained.

The high-strength steel sheet according to the present embodiment is not limited to those obtained by the above-described production method. The high-strength steel sheet according to the present embodiment may be those obtained by other production methods as long as the requirements prescribed in the present invention are satisfied.

The present description discloses various modes of techniques as described above, of which the main techniques are summarized below.

As described above, the high-strength cold-rolled steel sheet according to one aspect of the present invention contains, in % by mass: C: 0.070 to 0.140%; Si: 0.80 to 1.80%; and Mn: 1.80 to 2.80%, with a balance being iron and unavoidable impurities; in area ratio in a structure observed with a scanning electron microscope, bainite, tempered martensite, and hard phases composed of at least one of cementite and MA made up of quenched martensite and retained austenite combined together account for 85% or more in total, the hard phase that has a breadth of 0.4 μm or less and a length of 1.2 μm or more accounts for 0.5% or more, the hard phase that has a breadth of 1.2 μm or more accounts for 5.0% or less, and structures other than the bainite, the tempered martensite, and the hard phase account for 15% or less; and in volume ratio measured by X-ray diffractometry, retained austenite accounts for 3.0% or more and 7.0% or less.

According to this configuration, a high-strength cold-rolled steel sheet superior in stretch-flangeability and bendability can be obtained.

The high-strength cold-rolled steel sheet having the above configuration may further contain, in % by mass, one or more members selected from the group consisting of Al: 0.015 to 0.60%, Cr: more than 0% and 0.60% or less, Ti: 0.010 to 0.040%, B: 0.0015 to 0.0040%, Cu: more than 0% and 0.30% or less, Ni: more than 0% and 0.30% or less, Mo: more than 0% and 0.30% or less, V: more than 0% and 0.30% or less, Nb: more than 0% and 0.040% or less, and Ca: more than 0% and 0.0050% or less.

In accordance with this configuration, it is possible to obtain a high-strength cold-rolled steel sheet superior not only in stretch-flangeability and bendability but also in other properties.

The high-strength cold-rolled steel sheet having the above configuration may further contain, as the unavoidable impurities, in % by mass, P: more than 0% and 0.015% or less, and S: more than 0% and 0.0050% or less.

In accordance with this configuration, it is possible to obtain a high-strength cold-rolled steel sheet which is superior in stretch-flangeability and bendability and in which the influence of unavoidable impurities is controlled.

A hot-dip galvanized steel sheet and a hot-dip galvannealed steel sheet according to another aspect of the present invention include the above-described high-strength cold-rolled steel sheet and a hot-dip galvanized layer or a hot-dip galvannealed layer each provided on a surface of the high-strength cold-rolled steel sheet.

In accordance with this configuration, a hot-dip galvanized steel sheet or a hot-dip galvannealed steel sheet superior in stretch-flangeability and bendability can be obtained.

A method for producing a high-strength cold-rolled steel sheet according to another aspect of the present invention includes, in this order, a rolling step of subjecting a steel slab satisfying the above-described composition sequentially to hot rolling and cold rolling; a heating step of heating the steel sheet obtained by cold rolling the steel slab to a temperature region of ($Ac_3$ point+200° C.) or lower while adjusting a heating rate at 700° C. or more to 1.5° C./sec or more and 30° C./sec or less; a soaking step of holding the steel sheet subjected to the heating step for 10 seconds or more and 100 seconds or less; a first cooling step of cooling the steel sheet subjected to the soaking step to a first cooling temperature of 100° C. or higher and 410° C. or lower at a cooling rate of 10° C./sec or more and 50° C./sec or less; a holding step of holding the steel sheet cooled to the first cooling temperature at a holding temperature of 100° C. or higher and 410° C. or lower for 10 seconds or more and 80 seconds or less; and a second cooling step of cooling the steel sheet subjected to the holding step to room temperature at a cooling rate of 15° C./sec or more.

In accordance with this configuration, a high-strength cold-rolled steel sheet superior in stretch-flangeability and bendability can be produced.

In the method for producing the high-strength cold-rolled steel sheet having the above configuration, the first cooling temperature in the first cooling step may be 350° C. or higher and 410° C. or lower, and the holding temperature in the holding step may be 350° C. or higher and 410° C. or lower.

In accordance with this configuration, a high-strength cold-rolled steel sheet having a steel sheet structure based on bainite can be produced.

In the method for producing the high-strength cold-rolled steel sheet having the above configuration, the first cooling temperature in the first cooling step is 100° C. or higher and lower than 350° C.; the holding temperature in the holding step is 100° C. or higher and lower than 350° C.; and the method may further include, between the holding step and the second cooling step, a reheating step of reheating the steel sheet to a temperature of 400° C. or higher and 500° C. or lower and holding the steel sheet for 10 seconds or more.

In accordance with this configuration, a high-strength cold-rolled steel sheet having a steel sheet structure based on tempered martensite can be produced.

In a method for producing a hot-dip galvanized steel sheet and a method for producing a hot-dip galvannealed steel sheet according to another aspect of the present invention, the steel sheet is further subjected to galvanization or sequentially to galvanization and alloying treatment before the second cooling step in the above-described method for producing the high-strength cold-rolled steel sheet.

In accordance with this configuration, a hot-dip galvanized steel sheet or a hot-dip galvannealed steel sheet superior in stretch-flangeability and bendability can be obtained.

Hereinafter, the present invention will be described more specifically by way of examples; however, the present invention is not limited by the following examples and can be carried out while including some modifications within a scope conforming to the gist disclosed heretofore and hereinafter, all such modifications being encompassed within the technical scope of the present invention.

EXAMPLES

Slabs having the chemical compositions (steel type: steel 1 to 8) shown in Table 1 were produced. Each of the slabs was hot-rolled at a coiling temperature of 660° C. The resulting hot-rolled steel sheet was pickled and then subjected to cold rolling.

Thereafter, based on the heat pattern shown in FIGS. 2(A) to 2(D), heat treatment was carried out under the conditions shown in Table 2 (heat treatment 1 to 14). In Table 1, the column containing "–" means that the component is not added. In Table 1, values obtained by rounding off the measured values to the third decimal place are displayed as the contents of V, Nb, and Ca, and thus "0.00" for these contents means that the measured values were 0.004% or less. In addition, "N/A" means that the content was equal to or lower than the detection limit. P, S, N, and O are unavoidable impurities as described above, and the values shown in the columns of P, S, N, and O mean amounts unavoidably contained.

TABLE 1

| Steel | Composition (% by mass) Balance: Fe and inevitable impurities | | | | | | | | | | | | | | | | | $Ac_3$ point |
|---|---|---|---|---|---|---|---|---|---|---|---|---|---|---|---|---|---|---|
| type | C | Si | Mn | P | S | Al | Cr | Ti | B | Cu | Ni | Mo | V | Nb | Ca | O | N | (° C.) |
| 1 | 0.10 | 1.44 | 2.24 | 0.009 | 0.001 | 0.032 | 0.22 | 0.022 | 0.0026 | 0.01 | N/A | N/A | 0.01 | N/A | N/A | 0.0010 | 0.0039 | 869 |
| 2 | 0.10 | 1.51 | 2.18 | 0.010 | 0.001 | 0.033 | 0.20 | 0.023 | 0.0032 | 0.01 | 0.01 | N/A | 0.00 | N/A | N/A | 0.0019 | 0.0035 | 875 |
| 3 | 0.11 | 1.43 | 2.27 | 0.010 | 0.001 | 0.039 | 0.20 | 0.023 | 0.0032 | 0.01 | 0.01 | N/A | 0.01 | N/A | N/A | 0.0011 | 0.0058 | 869 |
| 4 | 0.10 | 1.50 | 2.27 | 0.012 | 0.001 | 0.038 | 0.18 | 0.022 | 0.0032 | 0.01 | 0.01 | N/A | 0.00 | N/A | N/A | 0.0009 | 0.0045 | 875 |
| 5 | 0.14 | 0.32 | 2.51 | 0.010 | 0.001 | 0.047 | 0.15 | 0.025 | 0.0032 | 0.01 | 0.01 | 0.10 | 0.00 | 0.00 | 0.00 | N/A | 0.0040 | 810 |
| 6 | 0.22 | 1.17 | 2.22 | 0.008 | 0.001 | 0.044 | 0.05 | 0.026 | 0.0016 | — | — | N/A | — | — | — | 0.0006 | 0.0038 | 834 |
| 7 | 0.10 | 1.02 | 2.02 | 0.010 | N/A | 0.020 | 0.50 | 0.022 | 0.0027 | N/A | N/A | N/A | N/A | N/A | — | — | 0.0040 | 849 |
| 8 | 0.12 | 0.99 | 2.34 | 0.010 | N/A | 0.370 | N/A | 0.022 | 0.0027 | N/A | N/A | N/A | N/A | N/A | — | — | 0.0040 | 978 |

TABLE 2

| | (a) Heating step | (b) Soaking step | | (c) First cooling step | | (d) Holding step | | (f) Reheating step | | (g) Plating step | | (h) Alloying step | | (e) Second cooling step |
|---|---|---|---|---|---|---|---|---|---|---|---|---|---|---|
| Heat treatment condition | Heating rate at 700° C. (° C./s) | Soaking temperature (° C.) | Soaking time (s) | First cooling rate (° C./s) | First cooling temperature (° C.) | Holding temperature (° C.) | Holding time (s) | Holding temperature (° C.) | Holding time (s) | Plating bath temperature (° C.) | Immersion time (s) | Alloying temperature (° C.) | Holding time (s) | Second cooling rate (° C./s) |
| 1 | 13 | 870 | 58 | 18 | 371 | 356 | 63 | — | — | 460 | 5 | 452 | 37 | 21 |
| 2 | 14 | 880 | 56 | 12 | 532 | 465 | 61 | — | — | 460 | 5 | 445 | 36 | 20 |
| 3 | 13 | 890 | 58 | 22 | 275 | 148 | 18 | 453 | 39 | 460 | 5 | 470 | 37 | 22 |
| 4 | 14 | 870 | 55 | 17 | 424 | 438 | 59 | — | — | 460 | 5 | 465 | 35 | 23 |
| 5 | 15 | 885 | 52 | 19 | 404 | 388 | 56 | — | — | 460 | 5 | 437 | 33 | 21 |
| 6 | 15 | 875 | 52 | 18 | 389 | 369 | 56 | — | — | 460 | 5 | 448 | 33 | 22 |
| 7 | 15 | 890 | 53 | 19 | 385 | 372 | 58 | — | — | 460 | 5 | 442 | 35 | 21 |
| 8 | 14 | 875 | 52 | 20 | 389 | 394 | 56 | — | — | 460 | 4 | 445 | 33 | 22 |
| 9 | 13 | 860 | 58 | 10 | 542 | 450 | 63 | — | — | 460 | 5 | 499 | 37 | 25 |
| 10 | 1 | 810 | 64 | 6 | 442 | 438 | 57 | — | — | 460 | 3 | 550 | 25 | 15 |
| 11 | 1 | 770 | 68 | 5 | 452 | 453 | 60 | — | — | 460 | 3 | 550 | 27 | 15 |
| 12 | 13 | 905 | 60 | 21 | 300 | 300 | 20 | 460 | 39 | 460 | 5 | 500 | 26 | 21 |
| 13 | 13 | 950 | 60 | 18 | 410 | 380 | 41 | — | — | 460 | 5 | 500 | 26 | 23 |
| 14 | 13 | 950 | 60 | 19 | 380 | 350 | 41 | — | — | 460 | 5 | 500 | 26 | 23 |

The heat treatment conditions 1 to 14 shown in Table 2 provided the same thermal history as in the case of a hot-dip galvannealed steel sheet. In Table 2, the "holding temperature" is a temperature at the end of the holding step, and hereinafter also referred to as "holding stop temperature". The "soaking temperature" is an average value in the temperature range in the soaking step that can be estimated from the measured value. In Table 2, the column containing "–" means that the reheating step is not carried out.

For each cold-rolled steel sheet thus obtained, the structure fraction (area ratio), the volume ratio of retained austenite, the sizes and shapes of the hard phases, and various properties (tensile properties, stretch-flangeability, bendability) were measured in accordance with the following procedures.

[Structure Fraction]

The metal structures of the base steel sheet constituting a steel sheet were observed by the following procedure. Among the metal structures, the area ratios of ferrite, pearlite, bainite, tempered martensite, and as-quenched martensite (including self-tempered martensite) were calculated on the basis of the results observed using a scanning electron microscope (SEM).

The observation by SEM was carried out as follows. A surface of a cross section parallel to the rolling direction of the base steel sheet was polished, and further electropolished. Then, the polished surface was etched with nital, and the position of ¼ the sheet thickness was observed in three fields of view with SEM at a magnification of 5000 times. The size of the observation field of view was set to about 30 μm×about 30 μm.

In the images observed in this way, the area ratio was not calculated for steel sheets apparently composed only of bainite or tempered martensite, and the area ratios were calculated by performing image processing only when ferrite, as-quenched martensite, or the like was present.

When observed with SEM, bainite and tempered martensite are observed as a structure in which MA and cementite (hard phase) are dispersed in crystal grains of bainite or tempered martensite. Bainite or tempered martensite is observed predominantly in gray, MA in white or light gray, and cementite in white, respectively. At this time, it is difficult to distinguish between retained austenite and quenched martensite constituting MA, and they are observed integrally.

When observed with SEM, since bainite also contains retained austenite and carbides, the area ratio of bainite is calculated as an area ratio including retained austenite and carbides.

In addition, ferrite is mainly observed in gray close to white, and MA and cementite are absent in crystal grains of ferrite. Pearlite is observed as a structure in which carbides and ferrite form layers. As-quenched martensite (including self-tempered martensite) is mainly observed in gray, and is observed as a structure in which extremely fine carbides are dispersed in crystal grains of as-quenched martensite.

[Volume Ratio of Retained Austenite]

Regarding retained austenite, a test piece having a sheet thickness×10 to 20 mm×10 to 20 mm was cut out from a cold-rolled steel sheet after annealing, and ground to a t/4 position of the sheet thickness t, and then chemically polished, and then the volume ratio of the retained austenite was measured by X-ray diffractometry (ISIJ Int. Vol. 33. (1993), No. 7, p. 776).

[Measurement of Size and Shape of Hard Phase]

Image processing was performed for the observation images obtained by SEM observation carried out when the structure fraction was determined, and image analysis was then carried out to calculate the breadth, length, and area of hard phases. The "length" was defined as the longest diameter of a hard phase, and the "breadth" was defined as the longest diameter in a direction perpendicular to the length. Using the calculated breadth, length, and area of the hard phases, the area ratios of the hard phase having a breadth of 0.4 μm or less and a length of 1.2 μm or more (the first hard phase) and the hard phase having a breadth of 1.2 μm or more (second hard phase) were calculated.

[Tensile Properties]

A JIS No. 5 test piece (plate-shaped test piece) was taken such that a direction perpendicular to a rolling direction on a plane parallel to a rolled surface of a steel sheet during cold rolling was the lengthwise direction of the test piece. A tensile test was carried out using the test piece, and a tensile strength TS and an elongation EL were measured. The ductility of the steel sheet was evaluated on the basis of the measured elongation EL.

[Stretch-Flangeability]

A test piece having a sheet thickness×90 mm×90 mm was taken from the cold-rolled steel sheet. Using the test piece, a hole expansion test was carried out according to JIS Z 2256:2010, and a hole expansion ratio λ was measured. The stretch-flangeability of the steel sheet was evaluated on the basis of the measured hole expansion ratio λ.

[VDA Bending Angle]

A test piece having a sheet thickness×60 mm×60 mm was taken from the cold-rolled steel sheet, and subjected to a bending test under the following conditions according to the VDA standard (VDA 238-100) defined by the German Association of the Automotive Industry. The displacement at the maximum load measured in the bending test was converted into an angle on the basis of the VDA standard, and the bending angle was determined.

(Measurement Conditions)

Test method: roll support, punch pushing

Roll diameter (diameter): ϕ30 mm

Punch shape: tip R=0.4 mm

Distance between rolls: plate thickness×2+0.5 mm

Punch pushing speed: 20 mm/min

Test piece dimensions: 60 mm×60 mm

Bending direction: direction perpendicular to rolling direction

Testing machine: SHIMADZU AUTOGRAPH 20 kN

The acceptance criteria for each test item are as follows.

Specimens having a tensile strength of 900 MPa or more, a ductility (elongation EL) of 12% or more, a stretch-flangeability (hole expansion ratio λ) of 60% or more, and a VDA bending angle of 100° or more were determined as acceptable, and the others were determined as unacceptable. The higher the elongation EL, the better the ductility, and the higher the hole expansion ratio λ, the better the stretch-flangeability. In addition, the higher the VDA bending angle is, the better the bendability is.

These results are shown in Table 3 together with the applied steel types and heat treatment conditions. In Table 3, the column containing "–" means that the measurement of the item is not carried out. The "balance structure" in Table 3 is a structure other than bainite, tempered martensite, and hard phases, and mainly includes pearlite, ferrite, and as-quenched martensite (including self-tempered martensite).

TABLE 3

| Test No. | Steel type | Heat treatment | Area ratio (%) of bainite, tempered martensite, and hard phase | Area ratio (%) of balance structure | Area ratio (%) of first hard phase | Area ratio (%) of second hard phase | Volume ratio (%) of retained austenite | Tensile strength TS (MPa) | Hole expansion ratio λ (%) | Elon-gation (%) | VDA bending angle (°) | Classi-fication |
|---|---|---|---|---|---|---|---|---|---|---|---|---|
| 1 | 1 | 1 | 100 | 0 | 0.82 | 1.14 | 5.3 | 1011 | 87 | 14 | 105 | Present invention example |
| 2 | 1 | 2 | 100 | 0 | 0.47 | 11.88 | 4.8 | 1010 | 36 | 15 | 89 | Compar-ative Example |
| 3 | 1 | 3 | 100 | 0 | 0.62 | 0.00 | 3.4 | 1019 | 97 | 13 | 102 | Present invention example |
| 4 | 2 | 4 | 100 | 0 | 0.63 | 5.75 | 3.3 | 964 | 39 | 14 | 117 | Compar-ative Example |
| 5 | 2 | 5 | 100 | 0 | 0.64 | 0.34 | 5.6 | 978 | 86 | 13 | >140 | Present invention example |
| 6 | 2 | 6 | 100 | 0 | 0.82 | 4.05 | 7.0 | 972 | 75 | 14 | >140 | Present invention example |
| 7 | 3 | 7 | 100 | 0 | 1.00 | 0.33 | 5.9 | 1031 | 73 | 14 | 114 | Present invention example |
| 8 | 3 | 8 | 91.91 | 8.09 | 0.85 | 2.44 | 5.7 | 1021 | 88 | 14 | 112 | Present invention example |
| 9 | 4 | 9 | 75.27 | 24.73 | 0.20 | 1.60 | 2.0 | 1045 | 31 | 13 | 75 | Compar-ative Example |
| 10 | 5 | 10 | — | — | — | — | — | 1293 | 51 | 8 | — | Compar-ative Example |
| 11 | 5 | 11 | — | — | — | — | — | 1256 | 23 | 12 | — | Compar-ative Example |
| 12 | 6 | 12 | 100 | 0 | — | — | 9.8 | 1154 | 49 | 12 | — | Compar-ative Example |
| 13 | 7 | 13 | 100 | 0 | 1.59 | 0.19 | 5.0 | 1004 | 76 | 13 | 113 | Present invention example |
| 14 | 8 | 14 | 100 | 0 | 0.79 | 0.12 | 5.0 | 1008 | 93 | 13 | 120 | Present invention example |

From the results shown in Table 3, it can be considered as follows.

Test Nos. 1, 3, 5 to 8, 13, and 14 were examples (present invention examples) produced using steel types satisfying the chemical composition prescribed in the present invention (steel 1 to 4, 7, 8 in Table 1) under appropriate heat treatment conditions (heat treatment Nos. 1, 3, 5 to 8, 13, and 14 in Table 2, all of which are thermal histories in producing hot-dip galvannealed steel sheets).

In all of these examples, the tensile strength was 900 MPa or more, the elongation EL was 12% or more, the hole expansion ratio λ was 60% or more, the VDA bending angle was 100° or more, and all of them satisfied the acceptance criteria. In each of the high-strength steel sheets of Test Nos. 1, 3, 5 to 8, 13, and 14, the microstructure satisfied the area ratios of bainite and tempered martensite, the volume ratio of retained austenite, the area ratios of the first hard phase and the second hard phase, and the area ratio of the balance structure prescribed in the present invention.

On the other hand, Test Nos. 2, 4, and 9 are examples (Comparative Examples) in which steel types satisfying the chemical composition prescribed in the present invention (steel 1 to 4 in Table 1) were used, but the steel sheets were produced under heat treatment conditions outside appropriate ranges (heat treatment 2, 4, and 9 in Table 2). In these examples, the desired properties were not obtained and the acceptance criteria was not satisfied.

Specifically, in Test No. 2, the first cooling temperature and the holding temperature (holding stop temperature) were high (heat treatment 2), the area ratio of the first hard phase was lower than 0.5%, the area ratio of the second hard phase was higher than 5.0%, the hole expansion ratio λ was less than 60%, and the VDA bending angle was less than 100°.

In Test No. 4, the first cooling temperature and the holding stop temperature were high (heat treatment 4). In the obtained steel sheet, the area ratio of the second hard phase was more than 5.0%, and the hole expansion ratio λ was less than 60%.

In Test No. 9, the first cooling temperature and the holding stop temperature were high (heat treatment 9). In the obtained steel sheet, the area ratio of the balance structure was higher than 15%, the area ratio of the first hard phase was less than 0.5%, the volume ratio of retained austenite was less than 3%, the hole expansion ratio λ was less than 60%, and the VDA bending angle was less than 100°.

On the other hand, Test No. 12 is an example (Comparative Example) in which a steel type not satisfying the chemical composition prescribed in the present invention (steel 6 in Table 1) was used, and the steel sheet was produced under appropriate heat treatment conditions (heat treatment 12 in Table 2). The desired properties were not obtained, and the acceptance criteria was not satisfied. Specifically, in Test No. 12, the amount of C was large (steel type 6), the volume ratio of retained austenite was higher than 7%, and the hole expansion ratio λ was less than 60%.

Furthermore, Test Nos. 10 and 11 are examples (Comparative Examples) in which a steel type not satisfying the chemical composition prescribed in the present invention (steel 5 in Table 1) was used, and the steel sheets were produced under heat treatment conditions outside the appropriate ranges (heat treatment 10 and 11 in Table 2). The desired properties were not obtained, and the acceptance criteria was not satisfied.

Specifically, in Test No. 10, the amount of Si was low (steel type 5), the heating rate at 700° C. or higher and the first cooling rate were low, and the first cooling temperature and the holding stop temperature were high (heat treatment 10). The obtained steel sheet had a hole expansion ratio λ of less than 60% and an elongation of less than 12%.

In Test No. 11, the amount of Si was low (steel type 5), the heating rate at 700° C. or higher and the first cooling rate were low, and the first cooling temperature and the holding stop temperature were high (heat treatment 11). The obtained steel sheet had a hole expansion ratio λ of less than 60%.

This application is based on Japanese Patent Application No. 2020-169102 filed on Oct. 6, 2020, the contents of which are incorporated herein.

The present invention has been appropriately and sufficiently described through the embodiments with reference to specific examples and the like in the foregoing to express the present invention, but it should be recognized that a person skilled in the art can easily change and/or improve the above-described embodiments. Therefore, unless a change or improvement made by a person skilled in the art is at a level departing from the scope of rights of the claims described in Claims, the change or improvement is interpreted to be included in the scope of rights of the claims.

INDUSTRIAL APPLICABILITY

The present invention has broad industrial applicability in the technical field relating to high-strength cold-rolled steel sheets, hot-dip galvanized steel sheets and hot-dip galvannealed steel sheets, and methods for producing these steel sheets.

The invention claimed is:

1. A cold-rolled steel sheet comprising, in % by mass:
C: 0.070 to 0.140%;
Si: 0.80 to 1.80%; and
Mn: 1.80 to 2.80%,
in area ratio in a structure observed with a scanning electron microscope,
bainite, tempered martensite, and hard phases composed of at least one of cementite and MA made up of quenched martensite and retained austenite combined together account for 85% or more in total,
the hard phase that has a breadth of 0.4 μm or less and a length of 1.2 μm or more accounts for 0.5% or more,
the hard phase that has a breadth of 1.2 μm or more accounts for 5.0% or less, and
structures other than the bainite, the tempered martensite, and the hard phases account for 15% or less; and
in volume ratio measured by X-ray diffractometry, retained austenite accounts for 3.0% or more and 7.0% or less,
wherein the cold-rolled steel sheet has a tensile strength of 900 MPa or more.

2. The cold-rolled steel sheet according to claim 1, further comprising, in % by mass:
one or more members selected from the group consisting of:
Al: 0.015 to 0.60%,
Cr: more than 0% and 0.60% or less,
Ti: 0.010 to 0.040%,
B: 0.0015 to 0.0040%,
Cu: more than 0% and 0.30% or less,
Ni: more than 0% and 0.30% or less,
Mo: more than 0% and 0.30% or less,
V: more than 0% and 0.30% or less,
Nb: more than 0% and 0.040% or less, and
Ca: more than 0% and 0.0050% or less.

3. The cold-rolled steel sheet according to claim 1, further comprising as unavoidable impurities, in % by mass:
P: more than 0% and 0.015% or less, and
S: more than 0% and 0.0050% or less.

4. The cold-rolled steel sheet according to claim 1, having a stretch-flangeability (hole expansion ratio λ) of 60% or more.

5. The cold-rolled steel sheet according to claim 1, having a VDA bending angle of 100° or more.

* * * * *